US011223141B2

(12) United States Patent
Liu

(10) Patent No.: US 11,223,141 B2
(45) Date of Patent: Jan. 11, 2022

(54) PLANAR ANTENNA MODULE

(71) Applicant: ACCTON TECHNOLOGY CORPORATION, Hsinchu (TW)

(72) Inventor: Chang-Cheng Liu, Hsinchu (TW)

(73) Assignee: ACCTON TECHNOLOGY CORPORATION, Hsinchu (TW)

( * ) Notice: Subject to any disclaimer, the term of this patent is extended or adjusted under 35 U.S.C. 154(b) by 149 days.

(21) Appl. No.: 16/505,033

(22) Filed: Jul. 8, 2019

(65) Prior Publication Data

US 2020/0083615 A1 Mar. 12, 2020

(30) Foreign Application Priority Data

Sep. 7, 2018 (CN) ..... 201821468159.6

(51) Int. Cl.

| | |
|---|---|
| ***H01Q 21/06*** | (2006.01) |
| ***H01Q 1/38*** | (2006.01) |
| ***H01Q 9/04*** | (2006.01) |
| ***H01Q 15/24*** | (2006.01) |

(52) U.S. Cl.

CPC ..... *H01Q 21/061* (2013.01); *H01Q 1/38* (2013.01); *H01Q 9/0421* (2013.01); *H01Q 9/0435* (2013.01); *H01Q 15/24* (2013.01)

(58) Field of Classification Search

CPC ..... H01Q 21/061; H01Q 1/38; H01Q 9/0435; H01Q 15/24; H01Q 9/0421; H01Q 21/065; H01Q 9/045; H01Q 21/24; H01Q 21/006; H01Q 21/0075; H01P 3/08; H01P 3/081

See application file for complete search history.

(56) References Cited

U.S. PATENT DOCUMENTS

| | | | | |
|---|---|---|---|---|
| 2004/0075613 | A1* | 4/2004 | Jarmuszewski | H01Q 9/26 343/702 |
| 2018/0219283 | A1* | 8/2018 | Wilkins | H01Q 9/045 |
| 2019/0165476 | A1* | 5/2019 | Hong | H01Q 19/005 |

* cited by examiner

*Primary Examiner* — David E Lotter

(74) *Attorney, Agent, or Firm* — Birch, Stewart, Kolasch & Birch, LLP

(57) ABSTRACT

A planar antenna module includes a plurality of planar antennas, a first transmission line electrically connected to the planar antennas, and at least one gain enhancement structure formed on the first transmission line. Each gain enhancement structure has a plurality of toothed portions spaced apart. With the design of the gain enhancement structure, the gain of the planar antenna module could be enhanced.

15 Claims, 12 Drawing Sheets

Antenna Pattern Test Report

| Vertical Polarization | Horizontal Polarization |
|---|---|
| 2.4GHz | |
| Vertical<br>Max Gain 14.46 | Horizontal<br>Max Gain 14.14 |
|  |  |

Antenna Pattern Test Report

| Vertical Polarization | Horizontal Polarization |
|---|---|
| 2.45GHz | |
| Vertical<br>Max Gain 15.1 | Horizontal<br>Max Gain 14.61 |
|  |  |

Antenna Pattern Test Report

| Vertical Polarization | Horizontal Polarization |
|---|---|
| 2.47GHz | |
| Vertical<br>Max Gain 14.02 | Horizontal<br>Max Gain 15.08 |
|  |  |

Antenna Pattern Test Report

| Vertical Polarization | Horizontal Polarization |
|---|---|
| 2.5GHz | |
| Vertical<br>Max Gain 13.83 | Horizontal<br>Max Gain 14.83 |
|  |  |

PLANAR ANTENNA MODULE

BACKGROUND OF THE INVENTION

Field of the Invention

The present invention relates to an antenna technology, and more particularly to a planar antenna module that has high gain.

Description of the Related Art

With the rapid development of wireless communication, such as wireless local area network (LAN) or mobile communication products, it is necessary to use wireless communication for signal transmission. Therefore, the demand for wireless signal bandwidth and data transmission rate is increasing day by day. Therefore, how to provide a planar antenna module with high gain and high wireless signal transmission rate is one of the efforts to develop and innovate.

SUMMARY OF THE INVENTION

The present invention has been accomplished under the circumstances in view. It is the main object of the present invention to provide a planar antenna module that has high gain.

To achieve this and other objects of the present invention, a planar antenna module comprises a plurality of planar antennas, a first transmission line electrically connected to the planar antennas, and at least one gain enhancement structure formed on at least one lateral edge of the first transmission line, wherein each gain enhancement structure includes a plurality of spaced apart toothed portions.

In an embodiment, the first transmission line has a plurality of first subsections and a first main section. Each first subsection has one end connected to one respective planar antenna, and another end thereof connected to the first main section.

In an embodiment, two gain enhancement structures are provided and respectively formed on the two opposite lateral edges of the first main section.

In an embodiment, the at least one gain enhancement structure is formed on the lateral edges of the first subsections.

In an embodiment, two gain enhancement structures are provided and respectively formed on the lateral edges of two of the first subsections. The two first subsections that carry the gain enhancement structures are connected to the same end of the first main section.

In an embodiment, a ratio of a length to a width of each toothed portion is between 0.15 and 12; the length of each toothed portion is between 0.3 mm and 3 mm, and the width of each toothed portion is between 0.25 mm and 3 mm.

To achieve this and other objects of the present invention, a planar antenna module comprises a plurality of planar antennas each having a first side and a second side adjacent to each other; a first transmission line electrically connected to the first sides of the planar antennas; a second transmission line electrically connected to the second sides of the planar antennas; and at least one gain enhancement structure formed on at least one lateral edge of at least one of the first transmission line and the second transmission line, wherein each gain enhancement structure has a plurality of spaced apart toothed portions.

In an embodiment, the first transmission line has a plurality of first subsections and a first main section. Each first subsection has one end thereof connected to the first sides of the planar antennas, and another end thereof connected to the first main section. The second transmission line has a plurality of second subsections and a second main section. Each second subsection has one end thereof connected to the second sides of the planar antennas, and another end thereof connected to the second main section.

In an embodiment, the gain enhancement structure is formed on a lateral edge of the first main section.

In an embodiment, two gain enhancement structures are provided and formed on the lateral edges of two of the first subsections.

In an embodiment, the gain enhancement structure is formed on a lateral edge of the second main section.

In an embodiment, two gain enhancement structures are further provided and formed on the lateral edges of two of the second subsections.

In an embodiment, a ratio of a length to a width of each toothed portion is between 0.15 and 12; the length of each toothed portion is between 0.3 mm and 3 mm, and the width of each toothed portion is between 0.25 mm and 3 mm.

With the design of the abovementioned gain enhancement structure, the gain of the planar antenna module could be enhanced effectively.

BRIEF DESCRIPTION OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
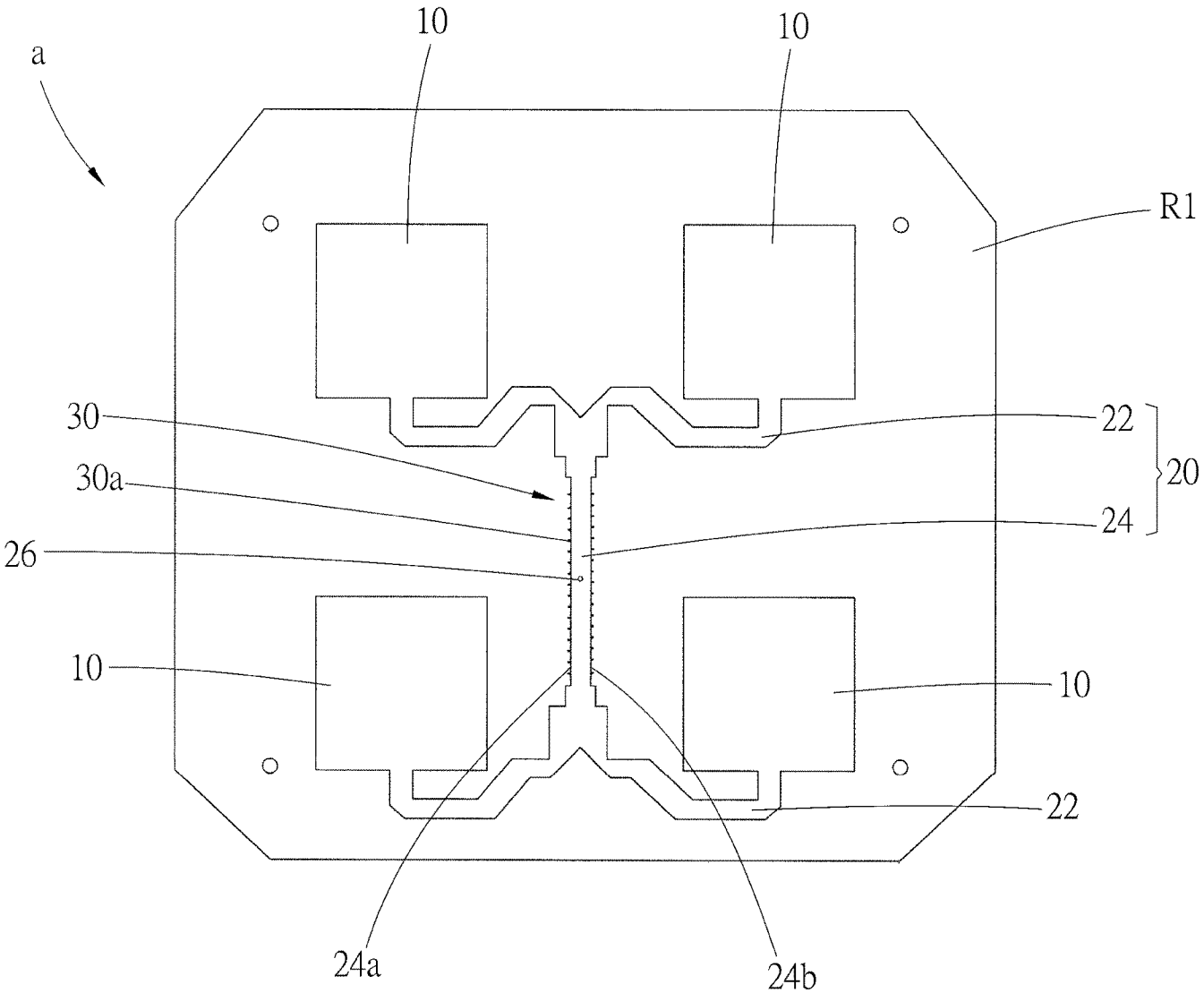
FIG. 1 is a schematic drawing showing a planar antenna module in accordance with a first embodiment of the present invention.

Referring to FIG. 1, a planar antenna module a in accordance with a first embodiment of the present invention is shown. As illustrated, the planar antenna module a comprises a plurality of planar antennas 10, a first transmission line 20, and at least two gain enhancement structures 30.

In this embodiment, the planar antenna module a includes four planar antennas 10 mounted or printed on a circuit board (not shown). A reflective plate R1 under the circuit board is connected to the circuit board. The reflective plate R1 is spaced apart from the circuit board by a predetermined distance and is adapted as a ground. However, the number of planar antennas and the circuit structure are not a limitation of the present invention.

The first transmission line 20 is electrically connected to the planar antennas 10 for accumulating the gain of each planar antenna 10. In this embodiment, the first transmission line 20 comprises a plurality of first subsections 22 and a first main section 24. Each first subsection 22 has an end connected to one planar antenna 10 respectively and another end connected to the first main section 24. In this embodiment, one end of the first main section 24 is connected to two first subsections 22 and the other end of the first main section 24 is connected to the other two first subsections 22. Further, the first main section 24 has a feed point 26 for feeding signals. More specifically, the first subsections 22 are respectively connected to the same side of each planar antenna 10, as shown in FIG. 1, the downward side of each planar antenna 10.

At least two gain enhancement structures 30 are formed on the first transmission line 20. Each gain enhancement structure 30 has a plurality of spaced apart toothed portions 30*a*. In this embodiment, the planar antenna module a includes two gain enhancement structures 30 respectively formed on two opposite lateral edges of the first transmission line 20 and facing opposite directions. More specifically, the two gain enhancement structures 30 are respectively formed on the two opposite lateral edges 24*a*, 24*b* of the first main section 24.

Figure 2:
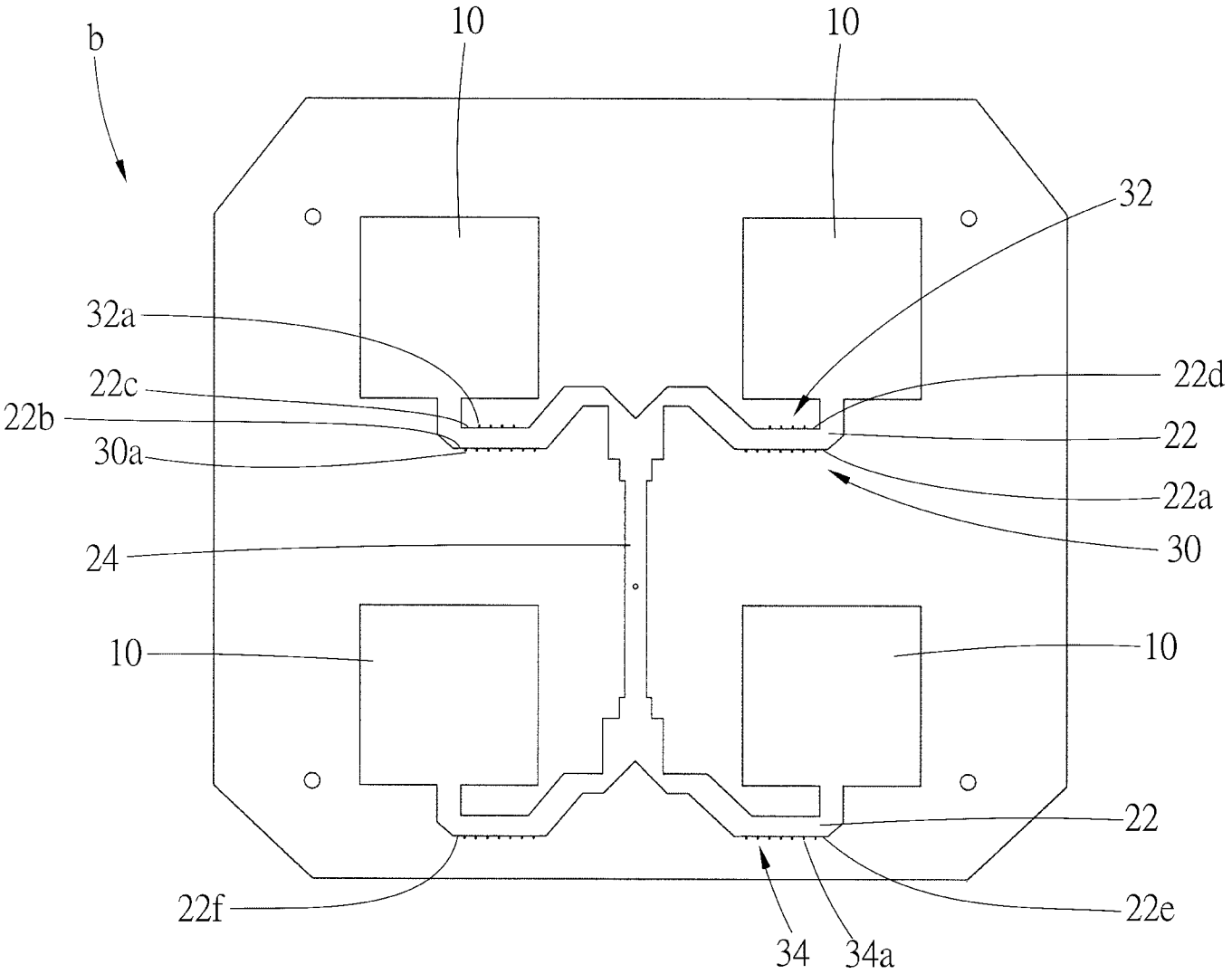
FIG. 2 is a schematic drawing showing a planar antenna module in accordance with a second embodiment of the present invention.

Referring to FIG. 2, a planar antenna module b in accordance with a second embodiment of the present invention is shown. The second embodiment is substantially similar to the planar antenna module a of the first embodiment, except that gain enhancement structures 30 are formed on two of the first subsections 22. More specifically, the two first subsections 22 that carry the two gain enhancement structures 30 are connected to the same end of the first main section 24, and the toothed portions 30*a* of the two gain enhancement structures 30 are respectively located on under lateral edges 22*a*,22*b* of the two corresponding first subsections 22. In addition, another gain enhancement structure 32 could be further provided in the same first subsection 22. For example, in an embodiment, toothed portions 32*a* are further formed on up lateral edges 22*c*,22*d* of the two first subsections 22 such that the opposing up and under lateral edges of the two upper first subsections 22 are respectively provided with a gain enhancement structure. Further, in an embodiment, still another gain enhancement structure 34 can be formed on the other first subsections 22. For example, in an embodiment, toothed portions 34*a* are respectively formed on the under lateral edges 22*e*,22*f* of the two lower first subsections 22. The arrangement of the gain enhancement structures is not a limitation of the present invention, for example, the toothed portions 34*a* of the gain enhancement structures 34 could be provided on the up lateral edges and/or under lateral edges of the first subsections 22. It should be noted that the gain enhancement structures are preferably symmetrically set on the corresponding two first subsections for achieving better gain enhancement. For example, the gain enhancement structures are symmetrically formed on the same lateral edges, the under lateral edges 22*c*,22*d* or the up lateral edges 22*a*,22*b*, of the two first subsections 22 that connected to the same end of the first main section 24.

Figure 3:
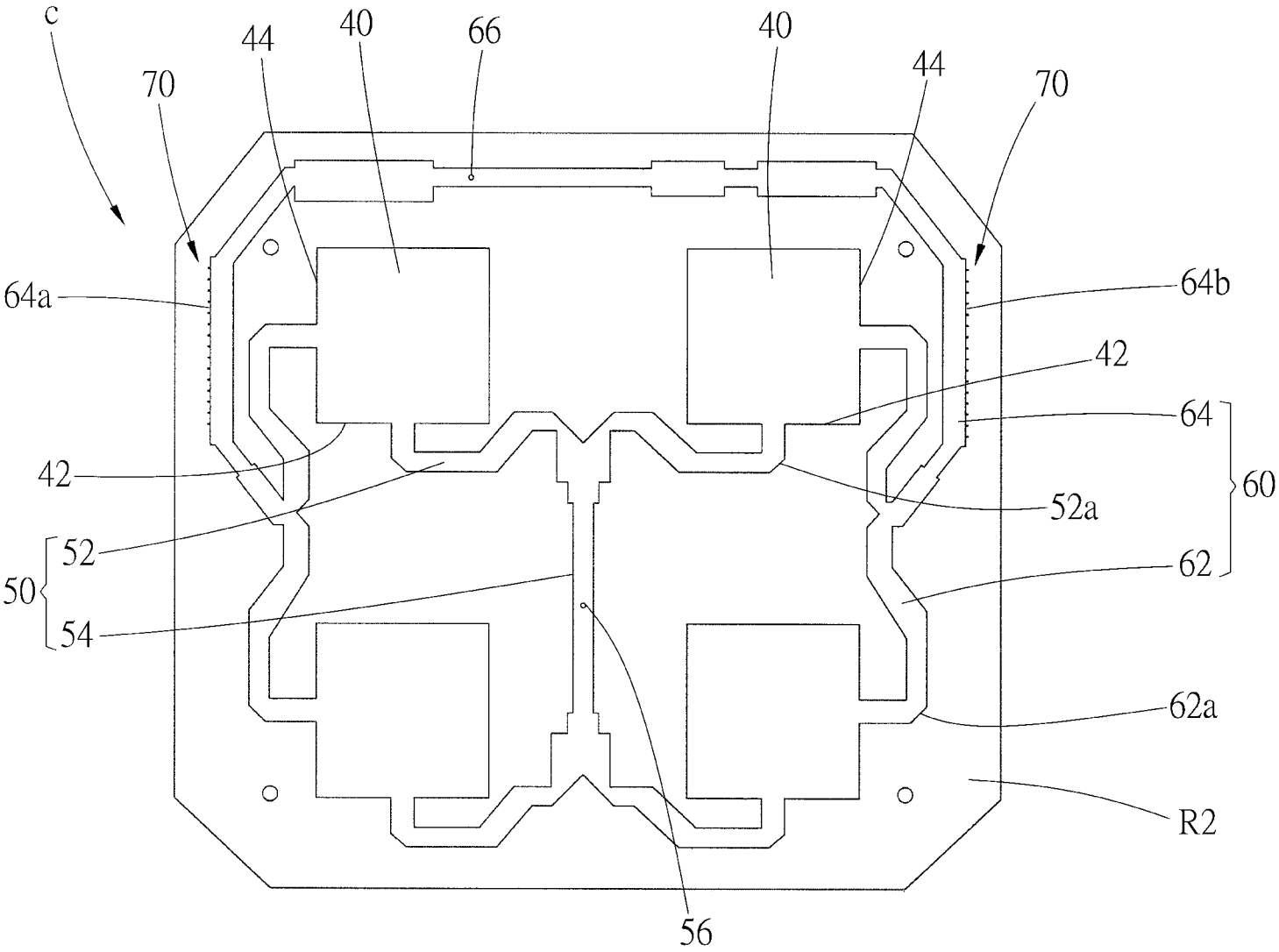
FIG. 3 is a schematic drawing showing a planar antenna module in accordance with a third embodiment of the present invention.

Referring to FIG. 3, a planar antenna module c in accordance with a third embodiment of the present invention is shown. The planar antenna module c is a dual-polarized patch antenna, comprising a plurality of planar antennas 40, a first transmission line 50, a second transmission line 60, and at least two gain enhancement structures 70.

In this embodiment, the planar antenna module c includes four planar antennas 40. The planar antennas 40 are mounted or printed on a circuit board (not shown). A reflective plate R2 under the circuit board is connected to the circuit board. The reflective plate R2 is spaced apart from the circuit board by a predetermined distance and could be used as a ground. However, the number of planar antennas and the circuit structure are not a limitation of the present invention. Each planar antenna 40 has a first side 42 and a second side 44 adjacent to each other. In this embodiment, in the direction shown in FIG. 3, the planar antennas 40 are arranged side by side in two parallel pairs from top down, wherein the first sides 42 of all planar antennas 40 face toward the same direction. For example, the first sides 42 face toward the downward direction of FIG. 3. Furthermore, the second sides 44 of the left and right planar antennas 40 face in opposite directions, for example, the second side 42 of the left side panel antenna 40 faces to the left, and the second side 42 of the right side panel antenna 40 faces to the right.

The first transmission line 50 is electrically connected to the planar antennas 40 for accumulating the gain of each planar antenna 40. In this embodiment, the first transmission line 50 comprises a plurality of first subsections 52 and a first main section 54. Each first subsection 52 has an end connected to the first side 42 of each planar antenna 40 respectively and another end thereof connected to the first main section 54. In this embodiment, one end of the first main section 54 is connected to two first subsections 52 and the other end of the first main section 54 is connected to the other two first subsections 52. Further, the first main section 54 has a first feed point 56 for feeding signals. In this embodiment, the first feed point 56 is a perforation as an example. Preferably, the first feed point 56 is located at a middle of the first main section 54. Further, a turning area of the first subsections 52 could provide with a lead angle 52*a*, thereby to enhance the antenna gain value.

The second transmission line 60 is electrically connected to the planar antennas 40 for accumulating the gain of each planar antenna 40. In this embodiment, the second transmission line 60 comprises a plurality of second subsections 62 and a second main section 64. Each second subsection 62 has an end connected to the second side 44 of one respective planar antenna 40 and another end thereof connected to the second main section 64. In this embodiment, one end of the second main section 64 is connected to two second subsections 62 and the other end of the second main section 64 is connected to the other two second subsections 62. Further, the second main section 64 has a second feed point 66 for feeding signals. In this embodiment, the second feed point 66 is a perforation as an example. In particular, the second transmission line 60 surrounds two of the planar antennas 40 such that the two planar antennas 40 are located between the second main section 64 of the second transmission lines 60. As shown in FIG. 3, the second main section 64 surrounds the left and right sides of the upper two planar antennas 40. In addition, preferably, the position of the second feed point 66 is deviated from a middle line or a middle point of the planar antenna module c. For example, the second feed point 66 could be disposed closer to one of the planar antennas 40, but away from the other planar antenna 40. For example, as shown in FIG. 3, the second feed point 66 is relatively close to the planar antenna 40 on the left side, and relatively far away from the planar antenna 40 on the right side. With the design of the feed position described above, the antenna isolation could be improved. Further, a turning area of the second subsection 62 could provide with a lead angle 62*a*, thereby to enhance the antenna gain value.

Figure 5:
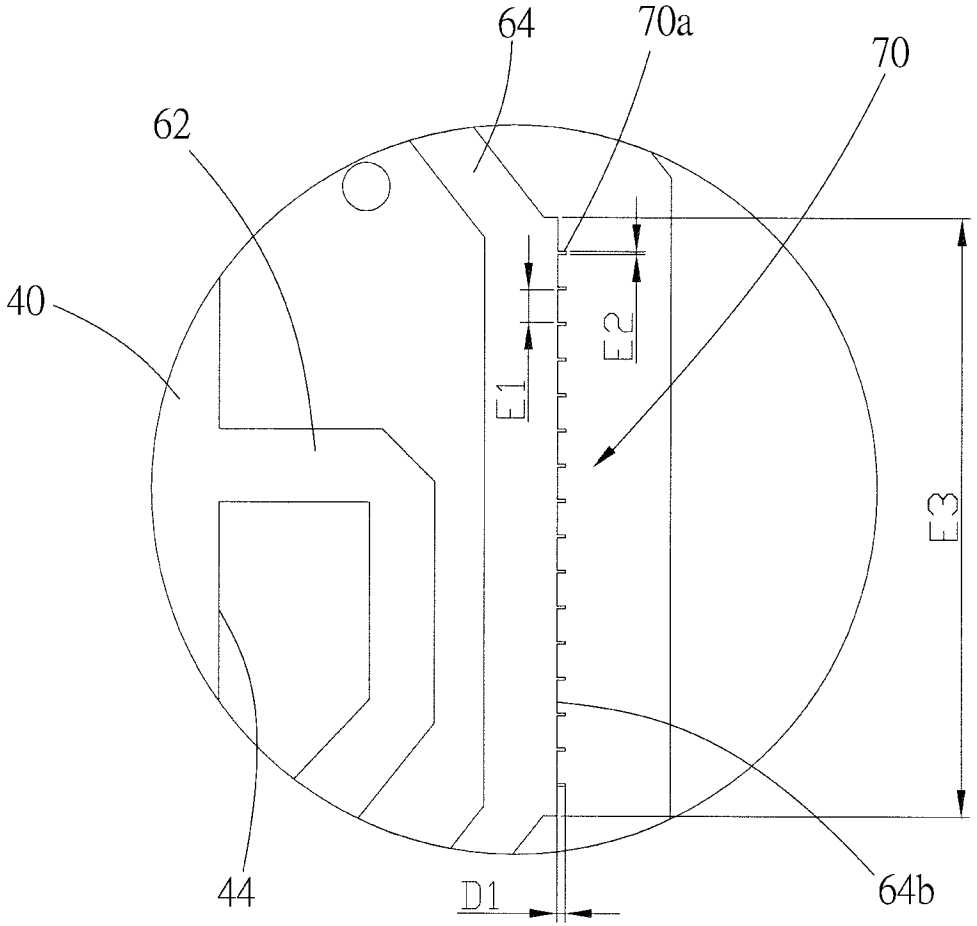
FIG. 5 is a partially enlarged view of the planar antenna module in accordance with the third embodiment of the present invention.

The at least two gain enhancement structures 70 are formed on at least one of the first transmission line 50 and the second transmission line 60. Each gain enhancement structure 70 has a plurality of spaced apart toothed portions 70*a* (as shown in FIG. 5). In this embodiment, the planar antenna module c includes two gain enhancement structures 70. The two gain enhancement structures 70 are respectively formed on two opposite lateral edges of the second main section 64 of the second transmission line 60, wherein the lateral edges of the second main section 64 that face in opposite directions or face toward each other. In this embodiment, the two gain enhancement structures 70 are respectively formed on the lateral edge 64*a* lateral edge 64*b* of the second main section 64 that face in opposite directions and are respectively disposed on the left side of one planar antenna 40 and the right side of the other planar antenna 40. Further, the toothed portions 70*a* of the gain enhancement structures 70 respectively protrude in opposite directions. As shown in FIG. 5, the toothed portions 70*a* of the gain enhancement structures 70 in this embodiment have a sheet-like rectangular configuration. However, in other embodiments, the shape of the toothed portions 70*a* is not limited to be the rectangular configuration, but could be zigzag, angular, convex arc, semicircle, concave arc, and the like.

Figure 4:
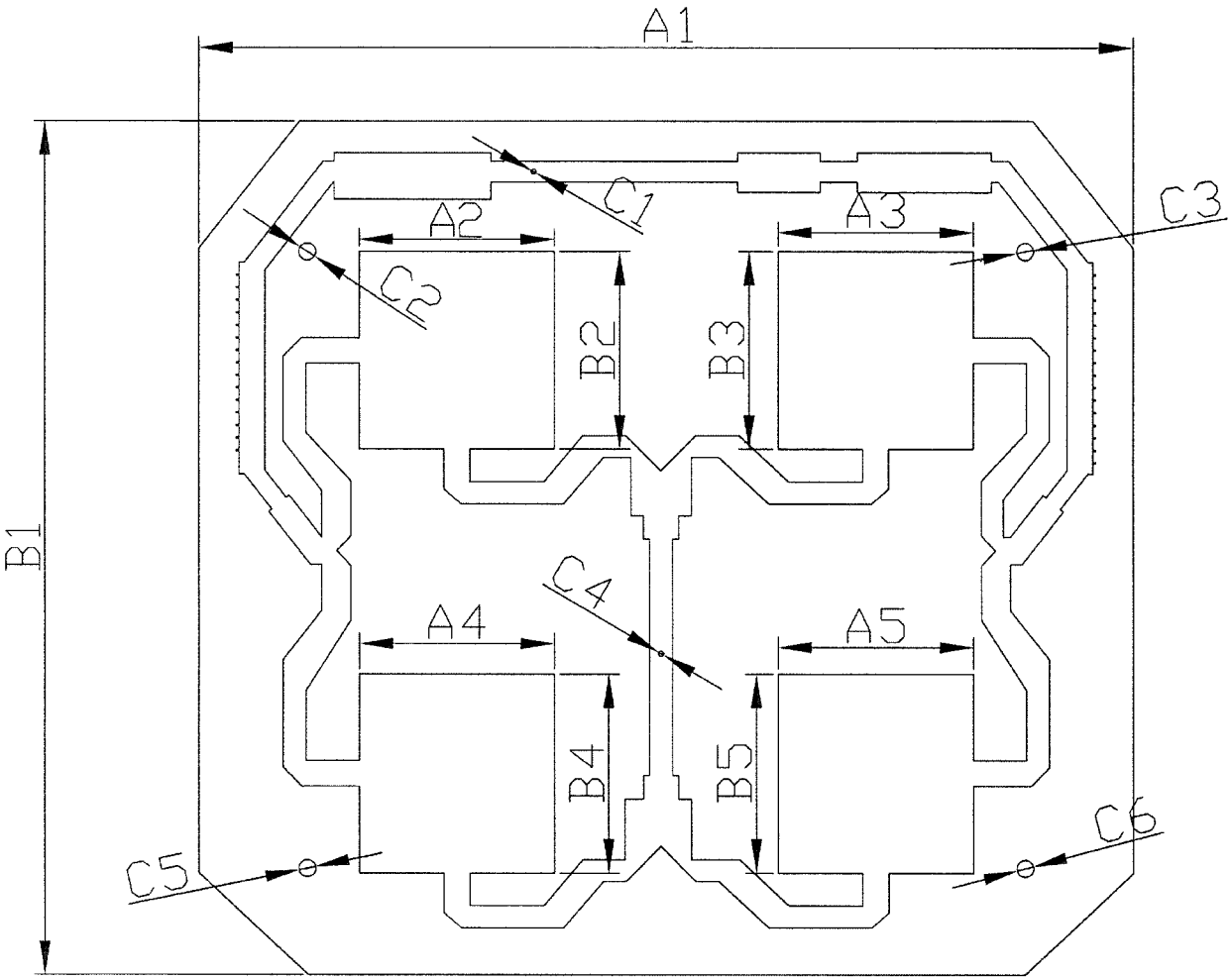
FIG. 4 is a schematic drawing of the planar antenna module in accordance with the third embodiment of the present invention.

Referring to FIG. 3, FIG. 4, and Table I shown below, the size design of the planar antenna module c of the current embodiment is shown, wherein A1 is a length of the reflective plate R2, B1 is a width of the reflective plate R2, A2-A5 are lengths of the planar antennas 40, B2-B5 are widths of the planar antennas 40, and C1 is a diameter of the perforation of the second feed point 66, C4 is a diameter of the perforation of the first feed point 56, and C2, C3, C5, and C6 are diameters of the perforations on the reflective plate R2. It should be noted that in other embodiments, the above dimensions are not unique, and the size design of the planar antenna module c could be changed depending on different embodiments.

TABLE I

| Dimension design of planar antenna module | | | | | Unit: mm |
|---|---|---|---|---|---|
| A1 = 220 | A2 = 45.95 | A3 = 45.95 | A4 = 45.95 | A5 = 45.95 | |
| B1 = 220 | B2 = 46.36 | B3 = 46.36 | B4 = 46.36 | B5 = 46.36 | |
| C1 = φ1.3 | C2 = φ4 | C3 = φ4 | C4 = φ1.3 | C5 = φ4 | C6 = φ4 |

As shown in FIG. 5, D1 is a length of each toothed portions 70*a* of the gain enhancement structure 70, E1 is a pitch of the toothed portions 70*a* of the gain enhancement structure 70, E2 is a width of each toothed portion 70*a* of the gain enhancement structure 70, E3 is the length of the lateral edge 64*b* that carries the gain enhancement structure 70. Preferably, the ratio of length to width of each toothed portion 70*a* is between 0.15 and 12; or, the length of each toothed portion is between 0.3 mm and 3 mm, and the width of each toothed portion is between 0.25 mm and 3 mm. In addition, preferably, the number of the toothed portions 70*a* of the gain enhancement structure 70 is between 4 and 32. In this embodiment, the number of the toothed portions 70*a* is 16 as an example. Further, the following Table II illustrates the dimension design of the gain enhancement structure 70 and the lateral edge 64*b* of the planar antenna module c. In this embodiment, the lateral edge 64*a* and the lateral edge 64*b* are symmetric and have the same size. It should be noted that in other embodiments, the above dimensions are not unique, and the size of the gain enhancement structure 70 could be changed depending on different embodiments.

TABLE II

| Dimension design of gain enhancement structure | | | | Unit: mm |
|---|---|---|---|---|
| D1 = 0.69 | E1 = 2.69 | E2 = 0.25 | E3 = 49.69 | toothed portion Number = 16 |

Figure 6A:
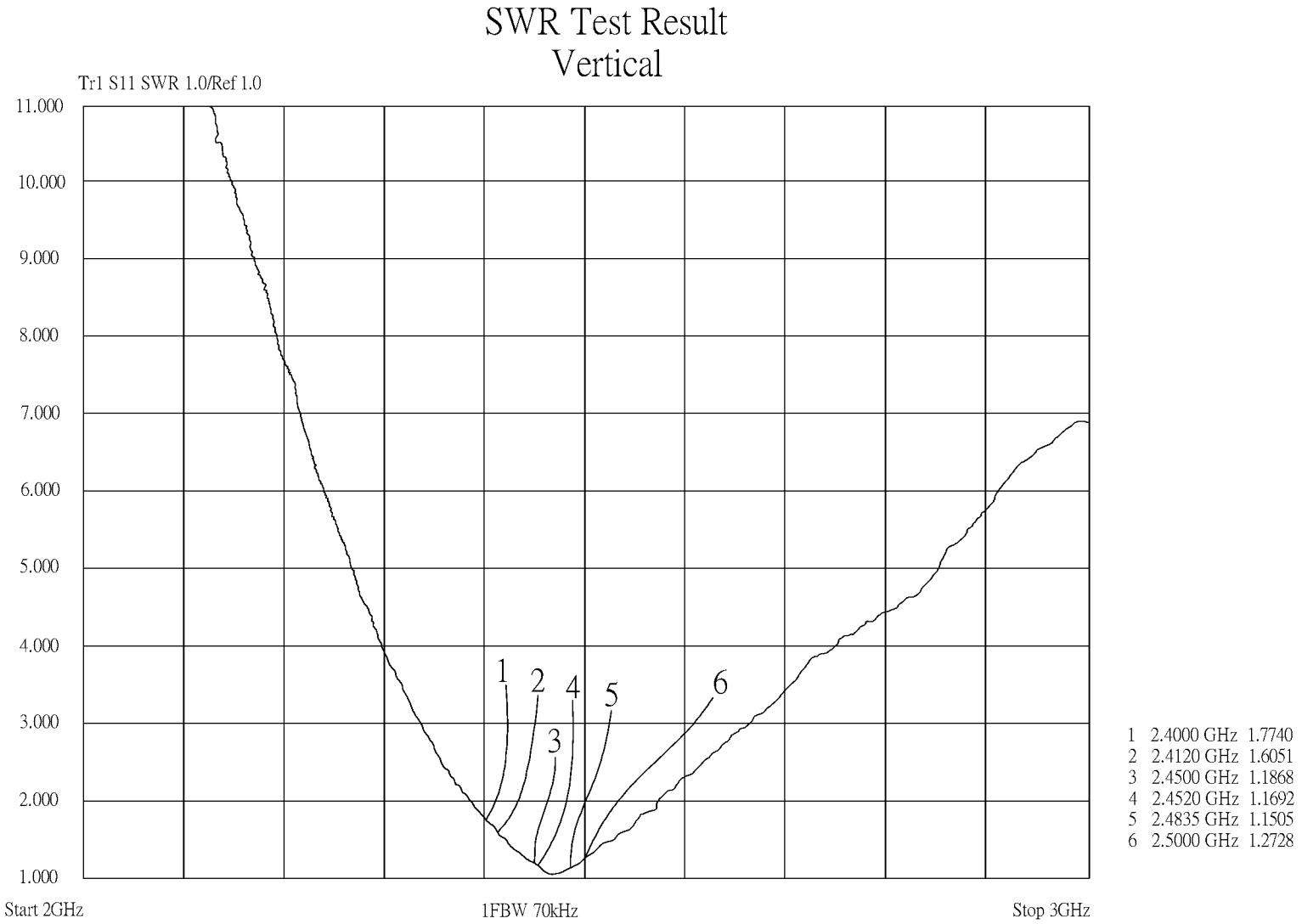
FIG. 6A is a test result of a vertical standing wave ratio test of the planar antenna module of the third embodiment of the present invention by using a vector analyzer.
Figure 6B:
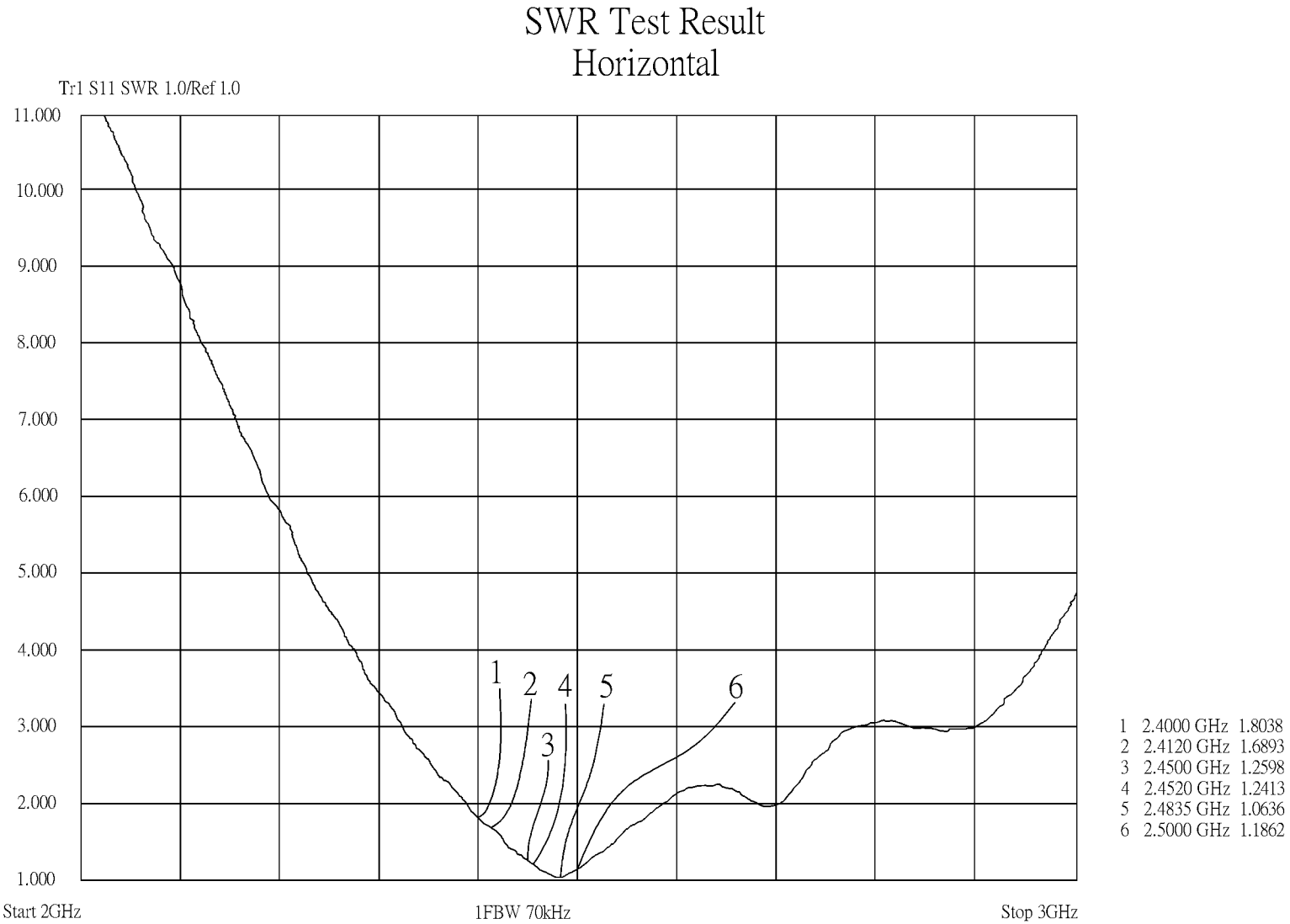
FIG. 6B is a test result of a horizontal standing wave ratio test of the planar antenna module of the third embodiment of the present invention by using a vector analyzer.

FIG. 6A and FIG. 6B show test results of a vertical standing wave ratio test and a horizontal standing wave ratio test of the planar antenna module c of the third embodiment of the present invention by using a vector analyzer. As shown in FIG. 6A and FIG. 6B, a return loss of the planar antenna module c between 2.4 GHz and 2.5 GHz is insignificant. It could be seen that the planar antenna module c of the third embodiment described above could be effectively applied in the bandwidth between 2.4 GHz and 2.5 GHz.

Figure 7:
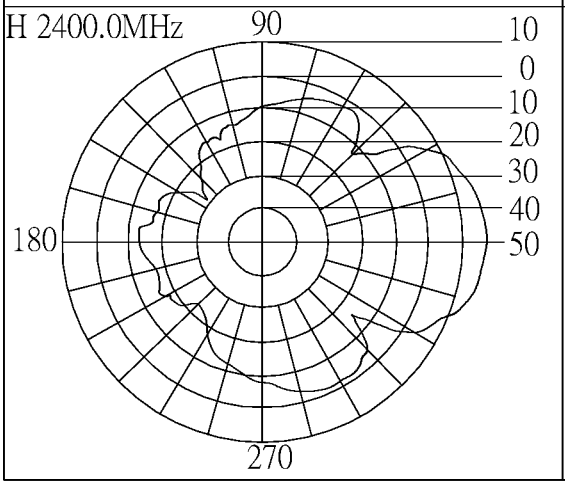
FIG. 7 is an antenna radiation pattern, showing a vertical polarization and a horizontal polarization direction of the planar antenna module operating at 2.4 GHz and 2.45 GHz according to the third embodiment of the present invention.
Figure 7:
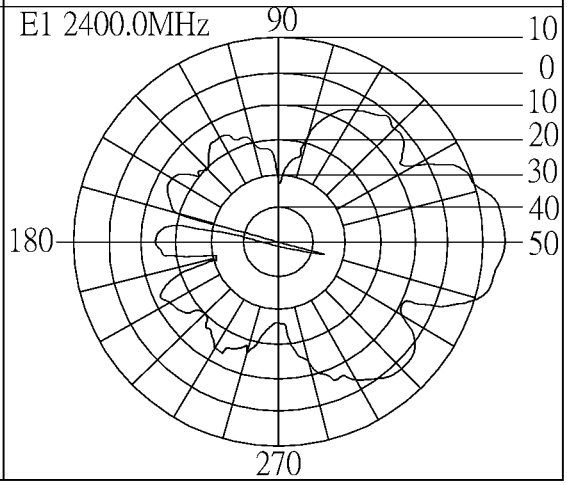
Figure 7:
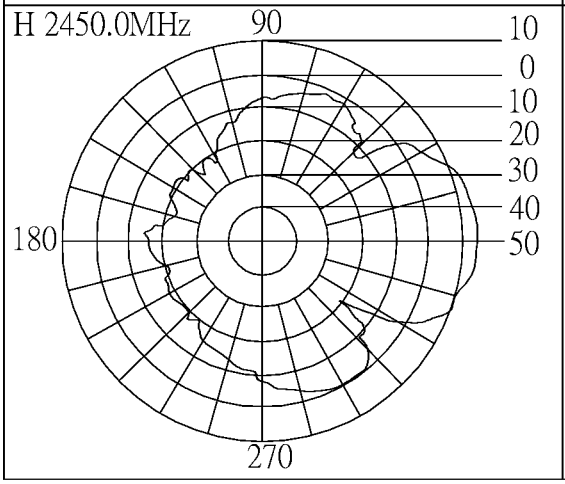
Figure 7:
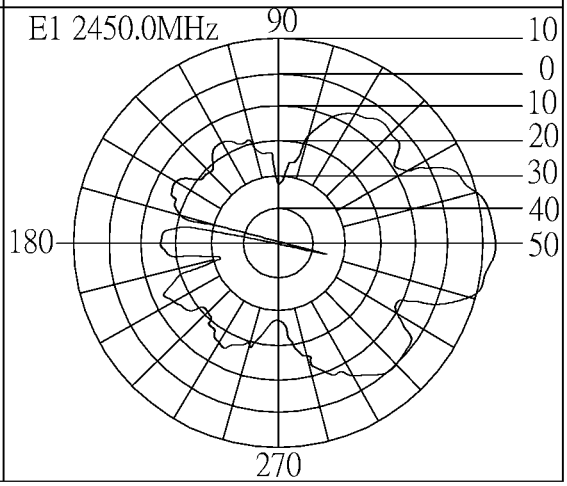
Figure 8:
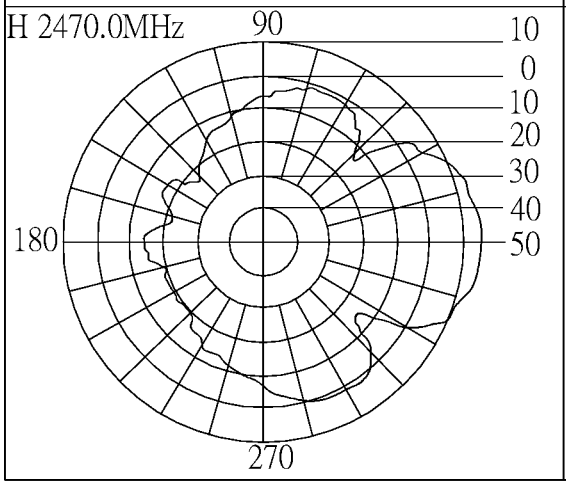
FIG. 8 is an antenna radiation pattern, showing a vertical polarization and a horizontal polarization of the planar antenna module operating at 2.47 GHz and 2.5 GHz according to the third embodiment of the present invention.
Figure 8:
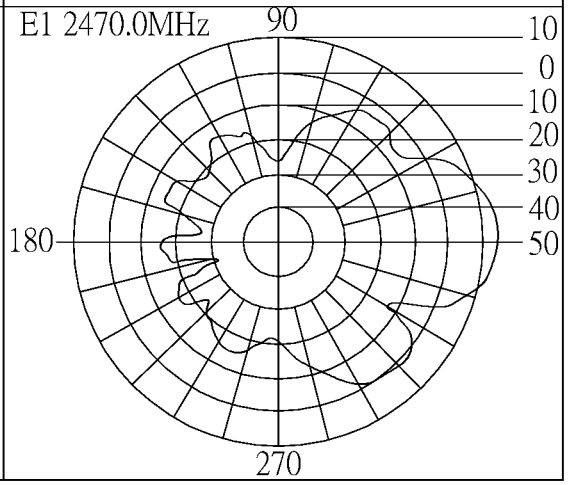
Figure 8:
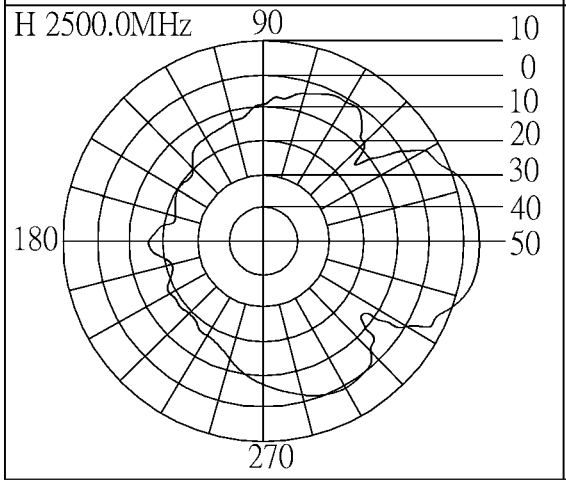
Figure 8:
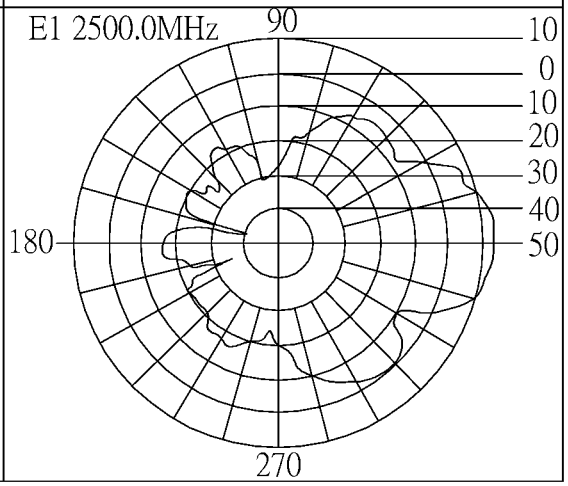

FIG. 7 and FIG. 8 are radiation field diagrams of a vertical polarization and a horizontal polarization of the planar antenna module c operating at 2.4 GHz and 2.45 GHz and at 2.47 GHz and 2.5 GHz according to the third embodiment of the present invention. It could be seen from the radiation field distribution of the diagrams, the planar antenna module c has good coverage.

In addition, referring to the following Table III, the experimental group is the planar antenna module c, and the control group is an antenna module having almost the same structures as the planar antenna module c except two gain enhancement structures 70. As can be seen from Table III, the design of the gain enhancement structure 70 of the planar antenna module of the present invention could effectively increase the gain of the antenna.

TABLE III

| Level polarization | | | | |
|---|---|---|---|---|
| Frequency (GHz) | 2.4 | 2.45 | 2.47 | 2.5 |
| Experimental group-planar antenna module c, maximum gain (dB) | 14.14 | 14.61 | 15.08 | 14.83 |
| Control group-antenna module (without gain enhancement structure 70), maximum gain (dB) | 13.9 | 14.18 | 14.41 | 14.39 |

Figure 9:
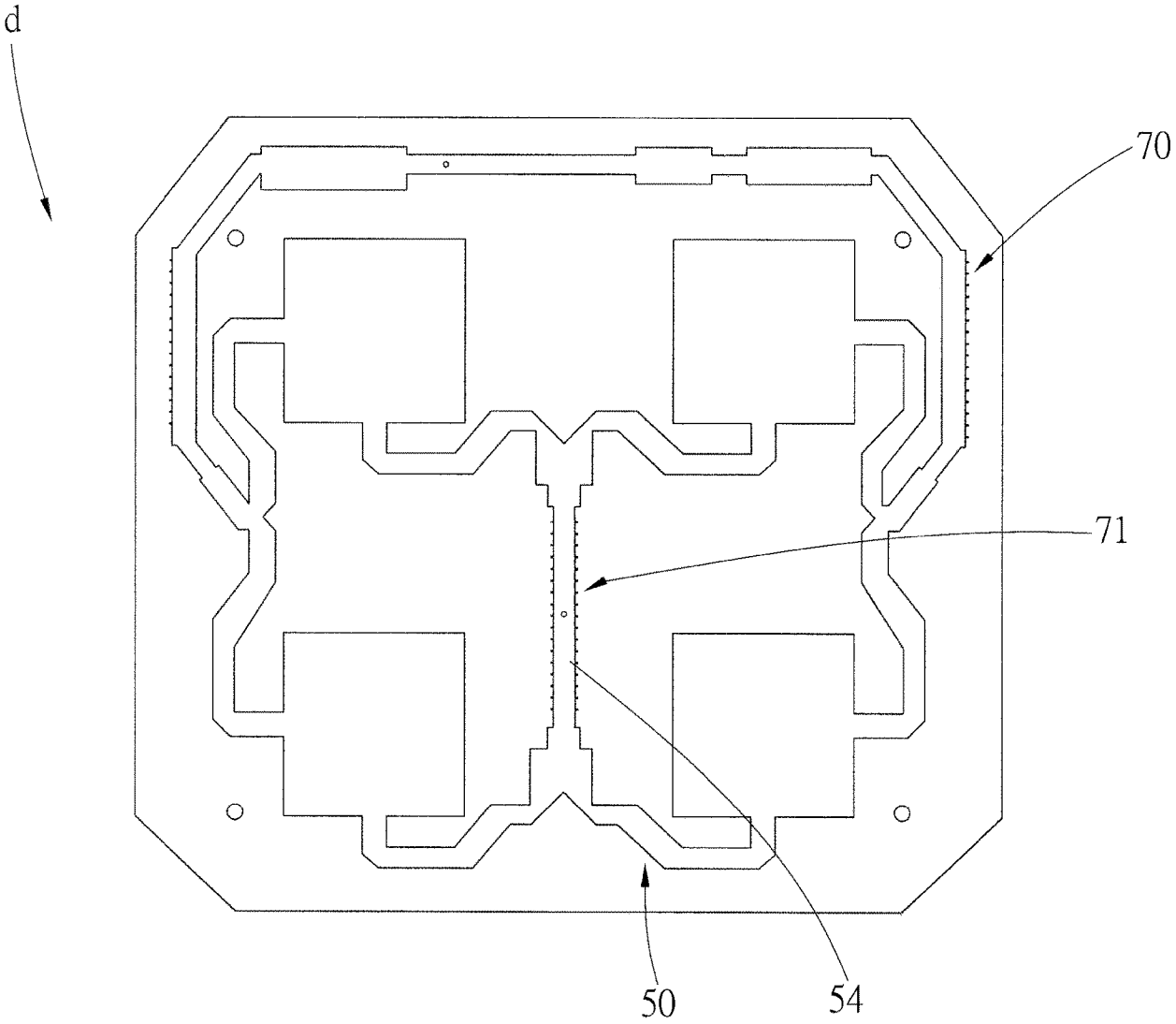
FIG. 9 is a schematic drawing of the planar antenna module in accordance with a fourth embodiment of the present invention.

Referring to FIG. 9, a planar antenna module d in accordance with a fourth embodiment of the present invention is shown, wherein the planar antenna module d according to the fourth embodiment is substantially similar to the planar antenna module c of the above-described third embodiment, except that the planar antenna module d further comprises two other gain enhancement structures 71 that are formed on the first transmission line 50. More specifically, the two gain enhancement structures 71 are respectively formed on the two opposite lateral edges of the first main section 54 of the first transmission line 50.

Figure 10:
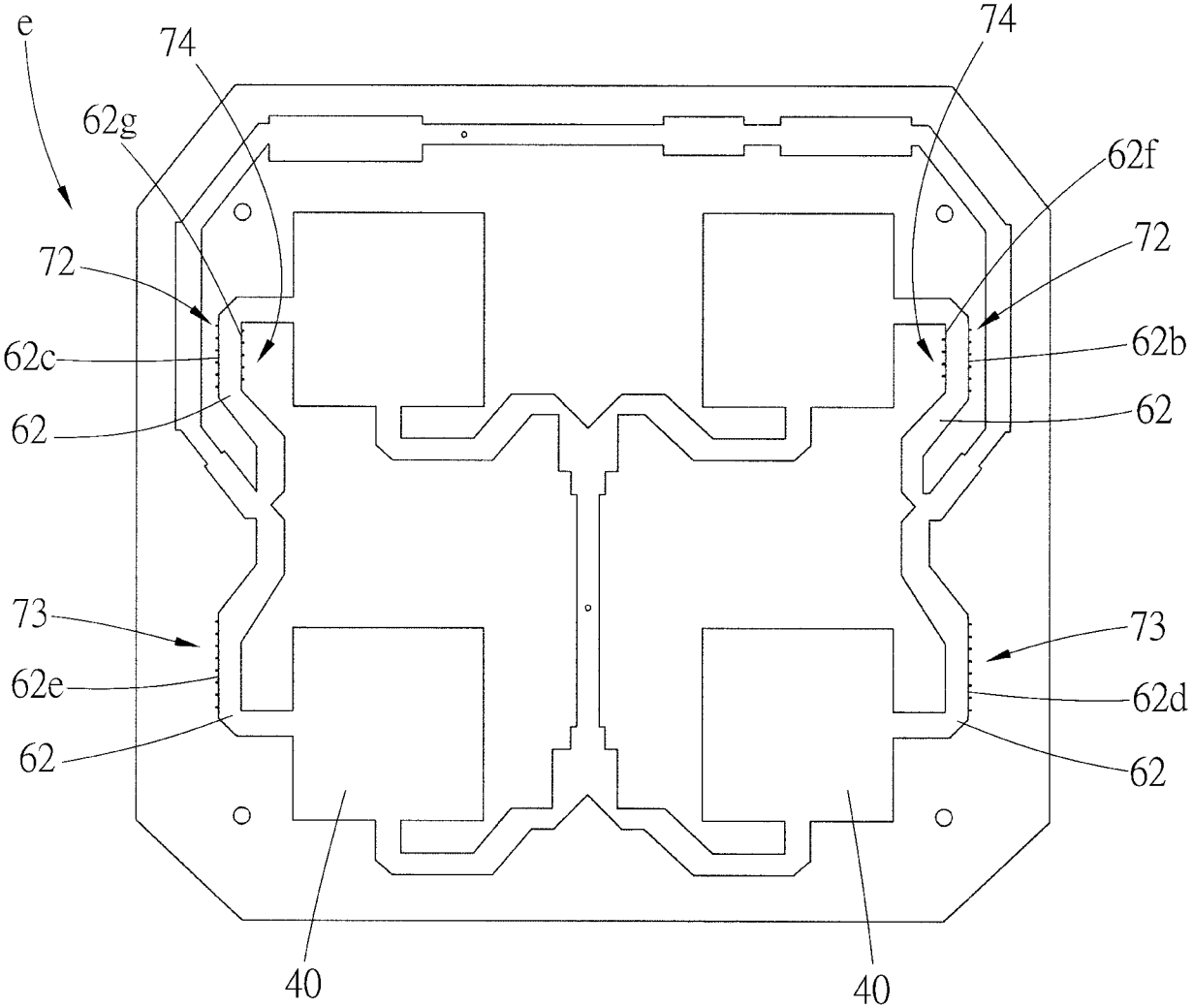
FIG. 10 is a schematic drawing of the planar antenna module in accordance with a fifth embodiment of the present invention.

Referring to FIG. 10, a planar antenna module e in accordance with a fifth embodiment of the present invention is shown, wherein the planar antenna module e according to the fifth embodiment is substantially similar to the planar antenna module c of the above-described third embodiment, except that the two gain enhancement structures 72 of the planar antenna module e are respectively formed on the lateral edges 62*b*, 62*c* of the two second subsections 62 of the first transmission line 50 located above. In addition, in an embodiment, gain enhancement structures 73 could be formed on the lateral edges 62*d*, 62*e* of the two second subsections 62 that connect to two lower planar antennas 40. Further, in an embodiment, the corresponding two gain enhancement structures 73 could be set to face each other. For example, two gain enhancement structures 74 are respectively formed on the lateral edges 62*f*, 62*g* of the two second subsections 62 to face each other, wherein the gain enhancement structures could be disposed on the lateral edge of the second subsection 62 close to the planar antenna 40, or on the lateral edge far away from the planar antenna 40. However, this is not a limitation of the present invention. It is worth mentioning that for better gain enhancement, the gain enhancement structures are preferably symmetrically formed on the corresponding two first subsections or the corresponding two second subsections. A preferred symmetric set relationship includes symmetry between the two first subsections, symmetry between the two second subsections, symmetry between the lateral edges of the two first subsections, and symmetry between the lateral edges of the two second subsections.

Figure 11:
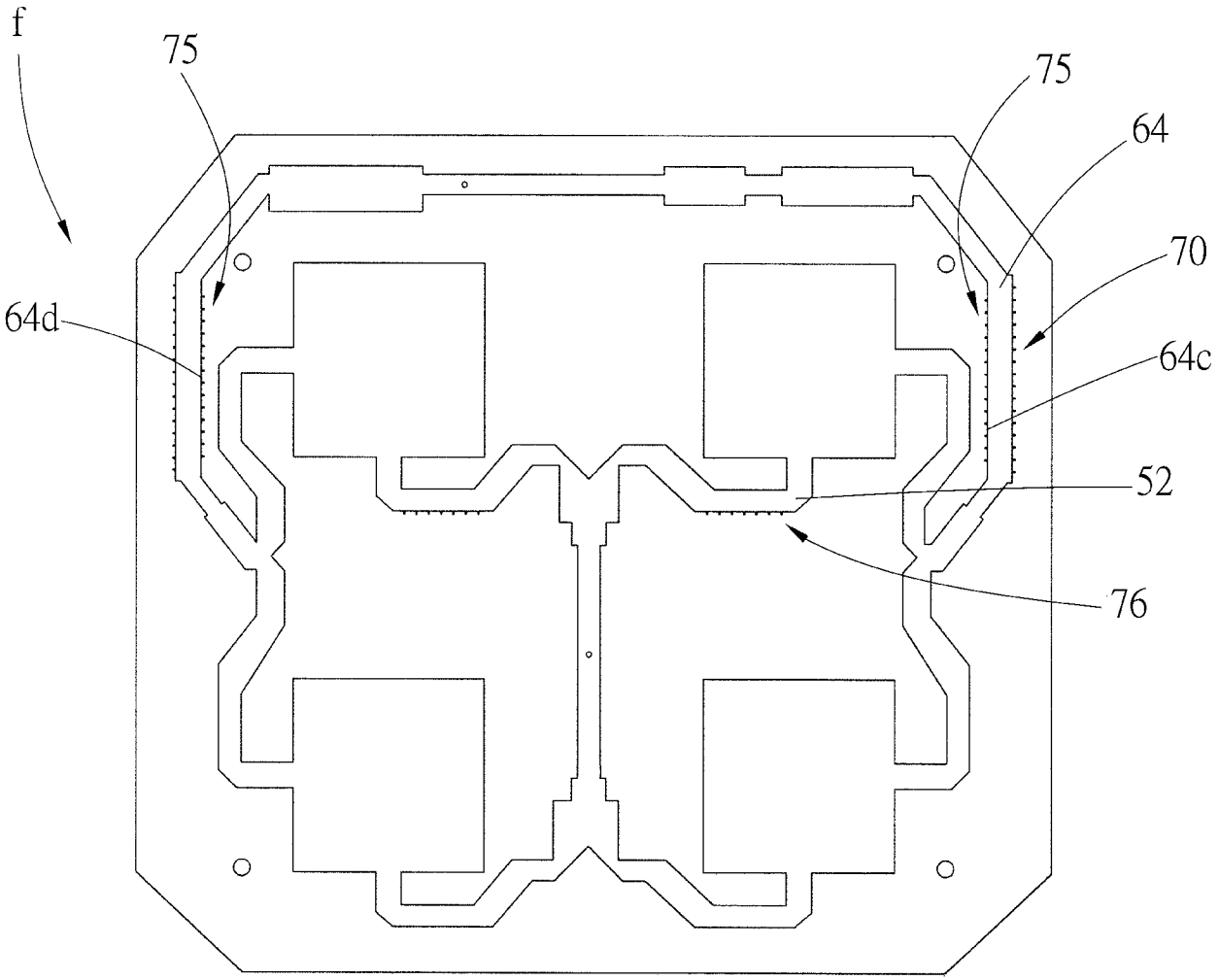
FIG. 11 is a schematic drawing of the planar antenna module in accordance with a sixth embodiment of the present invention.

Referring to FIG. 11, a planar antenna module f in accordance with a sixth embodiment of the present invention is shown, wherein the planar antenna module f according to the sixth embodiment is substantially similar to the planar antenna module c of the above-described third embodiment, except that the planar antenna module f further comprises two other gain enhancement structures 75 respectively formed on the lateral edges 64*c*, 64*d* of the second main section 64, wherein the two gain enhancement structures 75 face each other and face in opposite directions with the other two gain enhancement structures 70. The planar antenna module f further comprises two other gain enhancement structures 76 respectively formed on two of the first subsections 52, wherein the gain enhancement structure could be disposed on the lateral edge of the second main section 64 close to the planar antenna 40, or on the lateral edge far away from the planar antenna 40. However, this is not a limitation of the present invention. It is worth mentioning that for better gain enhancement, the gain enhancement structures are preferably symmetrically formed on the second main section, wherein a preferred symmetric set relationship includes symmetry between the two opposite lateral edges of the second main section.

The planar antenna module of the present invention could further increase the cumulative gain of the planar antenna and increase the gain value of the overall planar antenna module by using the above gain enhancement structures, which could improve the signal transmission rate of the planar antenna module.

In addition, the planar antenna, first transmission line, second transmission line, and gain enhancement structures described above could be made of a metal material such as gold, silver, copper, etc. In addition, preferably, the gain enhancement structure is integrally formed with the first transmission line or the second transmission line as a monolithic unit. Preferably, the planar antenna, the first transmission line, the second transmission line, and the gain enhancement structure are integrally formed as a monolithic unit.

It must be pointed out that the embodiments described above are only some preferred embodiments of the present invention. All equivalent structures which employ the concepts disclosed in this specification and the appended claims should fall within the scope of the present invention.

What is claimed is:

1. A planar antenna module, comprising a plurality of planar antennas;

a first transmission line electrically connected to said planar antennas; and at least one gain enhancement structure formed on at least one lateral edge of said first transmission line, wherein said gain enhancement structure has a plurality of spaced apart toothed portions, wherein the at least one lateral edge on which the at least one gain enhancement structure is formed extends straight, and the toothed portions extend toward a lateral direction with respect to the straight-extended lateral edge.

2. The planar antenna module as claimed in claim 1, wherein said first transmission line has a plurality of first subsections and a first main section; an end of each of said first subsections is connected to one of said planar antennas, and another end thereof is connected to said first main section.

3. The planar antenna module as claimed in claim 2, wherein the number of the at least one gain enhancement structure is two, the two gain enhancement structures are respectively formed on two opposite lateral edges of said first main section.

4. The planar antenna module as claimed in claim 2, wherein said at least one gain enhancement structure is correspondingly formed on lateral edges of said first subsections.

5. The planar antenna module as claimed in claim 2, wherein the number of the at least one gain enhancement structure is two, the two gain enhancement structures are respectively formed on two of said first subsections; the two first subsections with the gain enhancement structures are connected to a same end of said first main section.

6. The planar antenna module as claimed in claim 1, wherein a ratio of a length to a width of each said toothed portion is between 0.15 and 12; the length of each said toothed portion is between 0.3 mm and 3 mm, and the width of each said toothed portion is between 0.25 mm and 3 mm.

7. A planar antenna module, comprising:

a plurality of planar antennas having a first side and a second side adjacent to each other;

a first transmission line electrically connected to the said first sides of said planar antennas;

a second transmission line electrically connected to the said second sides of said planar antennas;

at least one gain enhancement structure formed on at least one lateral edge of at least one of said first transmission line and said second transmission line, wherein each said gain enhancement structure has a plurality of spaced apart toothed portions, wherein the at least one lateral edge on which the at least one gain enhancement structure is formed extends straight, and the toothed portions extend toward a lateral direction with respect to the straight-extended lateral edge.

8. The planar antenna module as claimed in claim 7, wherein said first transmission line has a plurality of first subsections and a first main section; an end of each of said first subsections is connected to said first sides of said planar antennas, and another end thereof is connected to said first main section; said second transmission line comprises a plurality of second subsections and a second main section, wherein an end of each of said second subsections is connected to said second sides of said planar antennas, and another end thereof is connected to said second main section.

9. The planar antenna module as claimed in claim 8, wherein said at least one gain enhancement structure is formed on a lateral edge of said first main section.

10. The planar antenna module as claimed in claim 8, wherein the number of the at least one gain enhancement structure is two, the two gain enhancement structures are correspondingly formed on lateral edges of at least two of said first subsections.

11. The planar antenna module as claimed in claim 8, wherein said at least one gain enhancement structure is correspondingly formed on a lateral edge of said second main section.

12. The planar antenna module as claimed in claim 9, further comprising one additional gain enhancement structure formed on a lateral edge of said second main section.

13. The planar antenna module as claimed in claim 8, wherein the number of the at least one gain enhancement structure is two, the two gain enhancement structures are correspondingly formed on lateral edges of at least two of said second subsections.

14. The planar antenna module as claimed in claim 10, further comprising two additional gain enhancement structures correspondingly formed on lateral edges of at least two of said second subsections.

15. The planar antenna module as claimed in claim 10, wherein a ratio of a length to a width of each said toothed portion is between 0.15 and 12; the length of each said toothed portion is between 0.3 mm and 3 mm, and the width of each said toothed portion is between 0.25 mm and 3 mm.

* * * * *